US009730303B1

(12) United States Patent
Lin

(10) Patent No.: US 9,730,303 B1
(45) Date of Patent: Aug. 8, 2017

(54) DIMMING CONTROL DEVICE AND SYSTEM

(71) Applicant: Kuo-Tsun Lin, Taichung (TW)

(72) Inventor: Kuo-Tsun Lin, Taichung (TW)

( * ) Notice: Subject to any disclaimer, the term of this patent is extended or adjusted under 35 U.S.C. 154(b) by 0 days.

(21) Appl. No.: 15/402,414

(22) Filed: Jan. 10, 2017

(30) Foreign Application Priority Data

May 12, 2016 (TW) ..... 105114659 A

(51) Int. Cl.
*H05B 37/02* (2006.01)
*F21V 23/04* (2006.01)

(52) U.S. Cl.
CPC ..... *H05B 37/0272* (2013.01); *F21V 23/04* (2013.01)

(58) Field of Classification Search
CPC ..... H05B 39/08; H05B 37/0272; F21V 23/04
USPC ..... 315/291
See application file for complete search history.

(56) References Cited

U.S. PATENT DOCUMENTS 4,365,237 A * 12/1982 Knight ..... G08B 7/06 200/61.03
5,900,682 A * 5/1999 Hung ..... H05B 39/08 200/51.15
7,477,030 B2 * 1/2009 Meckler ..... F04D 25/088 318/400.22
7,683,504 B2 * 3/2010 Blair ..... H05B 37/0272 307/141

* cited by examiner

*Primary Examiner* — Don Le
(74) *Attorney, Agent, or Firm* — The Mueller Law Office, P.C.

(57) ABSTRACT

A dimming control device is configured to be electrically connected to a pull switch for controlling a lighting device. The dimming control device includes a control module and a power module. The control module is configured to be electrically connected to the pull switch for receiving a trigger signal that is indicative of a pulled duration for which a cord of the pull switch is pulled and held in a pulled state. The power module is controlled by the control module according to the trigger signal to operate the lighting device by turning on/off lighting elements of the lighting device, or steplessly adjusting brightness of light emitted from any lighting element that is turned on.

15 Claims, 3 Drawing Sheets

DIMMING CONTROL DEVICE AND SYSTEM

CROSS-REFERENCE TO RELATED APPLICATION

This application claims priority of Taiwanese Patent Application No. 105114659, filed on May 12, 2016.

FIELD

The disclosure relates to a dimming control device and system for controlling a lighting device.

BACKGROUND

U.S. Pat. No. 6,504,317 B1 discloses a ceiling lamp brightness control device for adjusting brightness of a ceiling lamp with a zipper switch. The zipper switch includes a zipper, a conductive ring and a plurality of conductive pieces. By pulling the zipper, the conductive ring is driven to rotate to come into contact with at least a selected one of the conductive pieces. Accordingly, each time the zipper is pulled, a different resistor is conducted and a different resistance is exhibited. Thereby, the brightness of the ceiling lamp can be adjusted in steps. However, the steps are discrete and limited in number.

SUMMARY

Therefore, an object of the disclosure is to provide a dimming control device that can alleviate at least one of the drawbacks of the prior art.

According to the disclosure, the dimming control device is configured to be electrically connected to a pull switch for controlling a lighting device. The pull switch includes a cord and is configured to output a trigger signal indicative of a pulled duration for which the cord is pulled and held in a pulled state. The lighting device includes a plurality of lighting elements. The dimming control device includes a control module and a power module.

The control module is configured to receive electricity and to be electrically connected to the pull switch for receiving the trigger signal.

The power module is electrically connected to the control module, and is configured to receive the electricity and to be electrically connected to the lighting device. The power module is controlled by the control module according to the trigger signal to operate the lighting device by one of turning on at least a part of the lighting elements, turning off the lighting elements, and steplessly adjusting brightness of light emitted from active one(s) of the lighting elements that is(are) turned on.

Another object of the disclosure is to provide a dimming control system that can alleviate at least one of the drawbacks of the prior art.

According to the disclosure, the dimming control system is for controlling a lighting device including a plurality of lighting elements. The dimming control system includes a pull switch and a dimming control device.

The pull switch includes a cord, and is configured to output a trigger signal indicative of a pulled duration for which the cord is pulled and held in a pulled state.

The dimming control device is configured to be electrically connected to the pull switch, and includes a control module and a power module.

The control module is configured to receive electricity and to be electrically connected to the pull switch for receiving the trigger signal.

The power module is electrically connected to the control module, and is configured to receive the electricity and to be electrically connected to the lighting device. The power module is to be controlled by the control module according to the trigger signal to operate the lighting device by one of turning on at least a part of the lighting elements, turning off all the lighting elements, and steplessly adjusting brightness of light emitted from active one(s) of the lighting elements that is(are) turned on.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
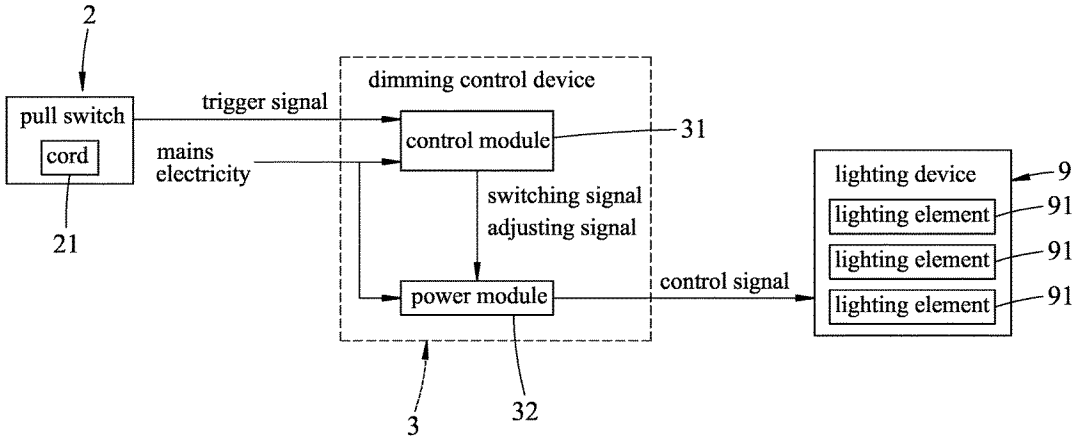
FIG. 1 is a block diagram of a first embodiment of a dimming control system according to this disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, the first embodiment of a dimming control system according to this disclosure is applied to a lighting device 9, and includes a pull switch 2 and a dimming control device 3. The lighting device 9 includes a plurality of lighting elements 91, such as light bulbs or light emitting diodes. In this embodiment, the lighting device 9 includes three lighting elements 91. However, the number of the lighting elements 91 is not limited to this disclosure, and may be varied according to requirement.

The pull switch 2 includes a cord 21, and is configured to output a trigger signal indicative of a pulled duration for which the cord 21 is pulled and held in a pulled state. For example, as the cord 21 is being pulled, the pull switch 2 outputs the trigger signal for an output duration that is equal to the pulled duration. The dimming control device 3 is electrically connected between the lighting device 9 and the pull switch 2 for controlling the lighting device 9, and includes a control module 31 and a power module 32.

The control module 31 and the power module 32 are configured to receive electricity, such as mains electricity. The control module 31 is electrically connected to the pull switch 2 for receiving the trigger signal, and is operable to output a switching signal when the pulled duration indicated by the trigger signal is shorter than a first predetermined duration, and to output an adjusting signal when the pulled duration is not shorter than the first predetermined duration. For example, a duration of the adjusting signal may depend on the output duration of the trigger signal (e.g., be equal to, be a fraction of, or be shorter by a fixed duration, such as the first predetermined duration).

The power module 32 is electrically connected to the control module 31 and the lighting device 9, and is to be controlled by the control module 31 according to the trigger signal to operate the lighting device 9 by turning on at least a part of the lighting elements 91, turning off all the lighting elements 91, or steplessly adjusting brightness of light emitted from active one (s) of the lighting elements 91 that is(are) turned on. The power module 32 is configured to operate the lighting device 9 according to one of the switching signal and the adjusting signal, whichever is received. For more details, the power module 32 is operable to adjust a number (N) of the active one(s) of the lighting elements 91 by turning on at least a part of the lighting elements 91 or turning off all the lighting elements 91 upon receiving the switching signal. On the other hand, when receiving the adjusting signal, the power module 32 is operable to steplessly adjust the brightness of light emitted from the active one (s) of the lighting elements 91 according to the duration of the adjusting signal, and to maintain the adjusted brightness of light after the adjusting signal ends. It is noted that when the number of active lighting elements 91 is two or more, the brightness adjustment may be realized in such a way that brightness is uniform among the individual lighting elements 91.

For example, the power module 32 is configured to output a control signal to the lighting device 9 according to one of the switching signal and the adjusting signal that is received. Upon receiving the switching signal, the power module 32 outputs a first control signal to the lighting device 9 so as to enable the lighting device 9 to turn on or off a number of the lighting elements 91 indicated by the first control signal. When receiving the adjusting signal, the power module 32 outputs a second control signal to the lighting device 9 so as to enable the lighting device 9 to steplessly adjust the brightness of light emitted from the active one(s) of the lighting elements 91 according to the duration of the adjusting signal. After the adjusting signal ends, the power module 32 outputs a third control signal to the lighting device 9 so as to enable the lighting device 9 to maintain the brightness of light after the adjustment.

In other embodiments, the power module 32 is configured to turn on the lighting element(s) 91 by providing the electricity thereto, to adjust the brightness of light emitted from the active one(s) of the lighting elements 91 by adjusting power of the electricity provided thereto, and to turn off the lighting elements 91 by ceasing to provide the electricity thereto.

In use, when a user rapidly pulls and releases the cord 21 within a period that lasts less than the first predetermined duration (e.g., two seconds), the control module 31 receives the trigger signal from the pull switch 2 and accordingly outputs the switching signal to the power module 32. Then, the power module 32 controls the lighting device 9 to adjust the number (N) of the active one(s) of the lighting elements 91 according to the switching signal. In this embodiment, the power module 32 is operable according to the switching signal to switch among a first mode to turn on one of the lighting elements 91 (i.e., N=1), a second mode to turn on two of the lighting elements 91 (i.e., N=2), a third mode to turn on all of the lighting elements 91 (i.e., N=3), and a fourth mode to turn off all of the lighting elements 91 (i.e., N=0). On the other hand, when the user pulls the cord 21 for over two seconds (i.e., the first predetermined duration), the control module 31 receives the trigger signal and accordingly outputs the adjusting signal to the power module 32, and then the power module 32 controls the lighting device 9 to adjust the brightness of the light emitted from the lighting device 9 according to the adjusting signal.

For example, assuming that all of the lighting elements 91 are turned off at the beginning, when the user rapidly pulls and releases the cord 21 twice, the power module 32 switches from the fourth mode to the second mode to turn on two of the lighting elements 91. Then, the user pulls the cord 21 again and holds the cord 21 in the pulled state for over two seconds, the brightness of the light emitted from the two lighting elements 91 of the lighting device 9 changes steplessly from an initial brightness to being brightest and then from being the brightest to being dimmest repeatedly until the cord 21 is released. When a desired level of the brightness of light is achieved, the user can simply release the cord 21 so as to maintain the desired level of the brightness of light.

It is noted that an adjustable range of the brightness of light emitted from the number (N) of the lighting elements 91 has a lower limit level and a higher limit level. The lower limit level is higher than a preset level of the brightness of light that is emitted from the lighting device 9 upon turning on a number (N−1) of the lighting elements 91 without any adjustment (i.e., the initial brightness when the number (N−1) of the lighting elements 91 is(are) turned on), and the higher limit level is lower than a preset level of the brightness of light that is emitted from the lighting device 9 upon turning on a number (N+1) of the lighting elements 91 without any adjustment (i.e., the initial brightness when the number (N+1) of the lighting elements 91 are turned on). For example, in this embodiment, a first preset level of the brightness of light emitted from the lighting device 9 upon turning on one lighting element 91 is a quarter of a maximum brightness (i.e., 25% of the maximum brightness), a second preset level of the brightness of light emitted from the lighting device 9 upon turning on two lighting elements 91 is half of the maximum brightness (i.e., 50% of the maximum brightness), and a third preset level of the brightness of light emitted from the lighting device 9 upon turning on three lighting elements 91 is three quarters of the maximum brightness (i.e., 75% of the maximum brightness). Certainly, when all of the lighting elements are turned off, the brightness is zero. When two lighting elements 91 are active and the power module 32 receives the adjusting signal, the adjustable range of the brightness of light emitted from the lighting device 9 is 25%-75% of the maximum brightness.

In other embodiments, the control module 31 may be configured to output one of the switching signal and the adjusting signal further according to a second predetermined duration that is longer than the first predetermine duration. More precisely, the control module 31 is configured to output the switching signal when the pulled duration indicated by the trigger signal is shorter than the first predetermined duration (e.g., one second), and to output the adjusting signal when the pulled duration is longer than the second predetermined duration (e.g., two seconds). In some embodiments, the control module 31 may be idle when the pulled duration is between the first and second predetermined durations, and the first and second predetermined durations may be set by the user according to actual demand. As a result, an error rate on determining to output which of the switching signal and the adjusting signal can be decreased.

In other embodiments, the power module 32 may be configured to be operable according to the switching signal to switch only between a turn-on mode to turn on all of the lighting elements 91 and a turn-off mode to turn off all of the lighting elements 91. The adjustable range of the brightness of light emitted from the lighting elements 91 in this case is between a minimum brightness and the maximum brightness.

Figure 2:
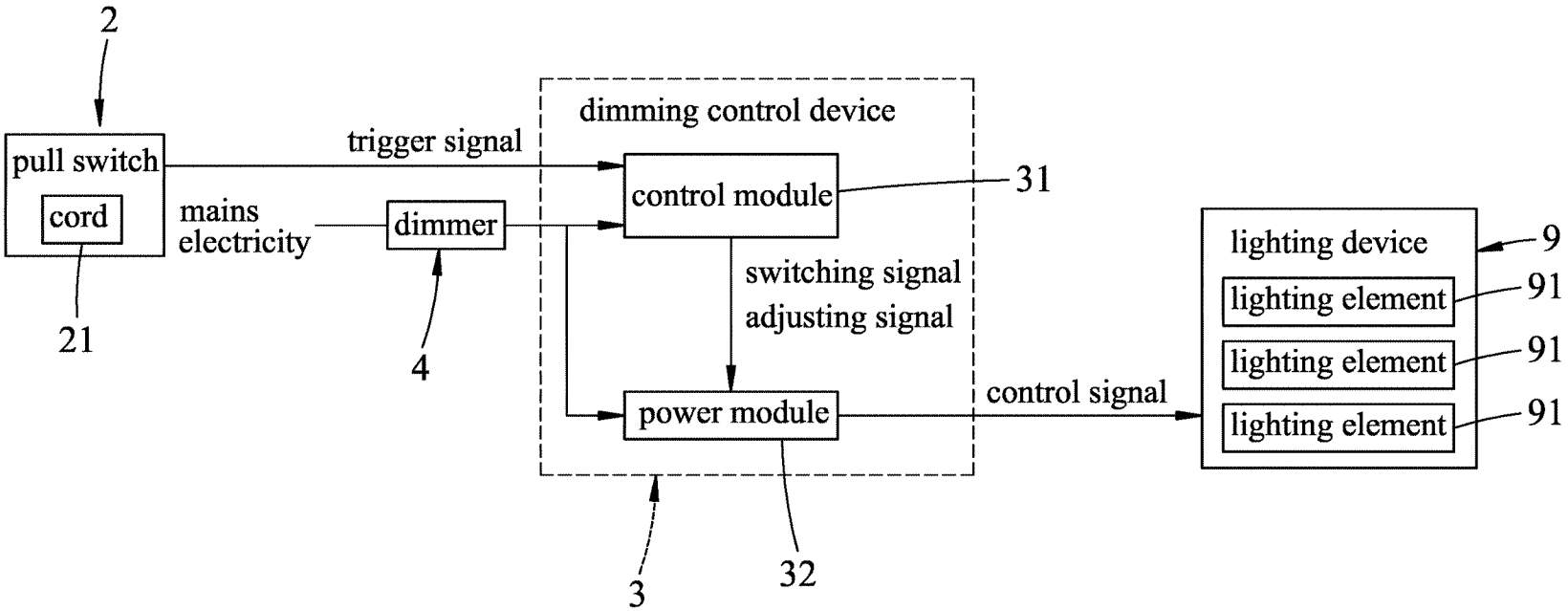
FIG. 2 is a block diagram of a second embodiment of a dimming control system according to this disclosure.

Referring to FIG. 2, the second embodiment of a dimming control system according to this disclosure is shown to be similar to the first embodiment. In the second embodiment, the control module 31 and the power module 32 are further electrically connected to a dimmer 4, and receive the electricity from the dimmer 4. The dimmer 4 is electrically connected to an electric power source, such as a mains electricity supply, for receiving the electricity. The control module 31 is configured to determine whether the electricity received thereby has been processed by the dimmer 4 by detecting a zero-crossing point of the electricity, and to control the power module 32 to directly provide the electricity to the lighting device 9 without further processing the electricity when it is determined that the electricity has been processed by the dimmer 4. On the other hand, when the electricity is directly from the mains electricity supply without having gone through processing, it is determined that the electricity has not been processed by the dimmer 4, and operation of the dimming control device 3 is exactly the same as the first embodiment. In particular, the control module 31 determines whether the electricity has been processed by the dimmer 4 or not according to a cycle of occurrence of the zero-crossing points and an interval between the zero-crossing points. When the electricity has been processed by the dimmer 4, the control module 31 controls the power module 32 to not process the electricity, and, the lighting device 9 is directly controlled by the dimmer 4 rather than by the dimming control device 3. At this time, if the user pulls or holds the cord 21 and the pull switch 2 outputs the trigger signal to the control module 31, the control module 31 will ignore the trigger signal. By determining whether the electricity has been processed by the dimmer 4, the dimming control device 3 and the dimmer 4 can be prevented from interfering with each other.

Figure 3:
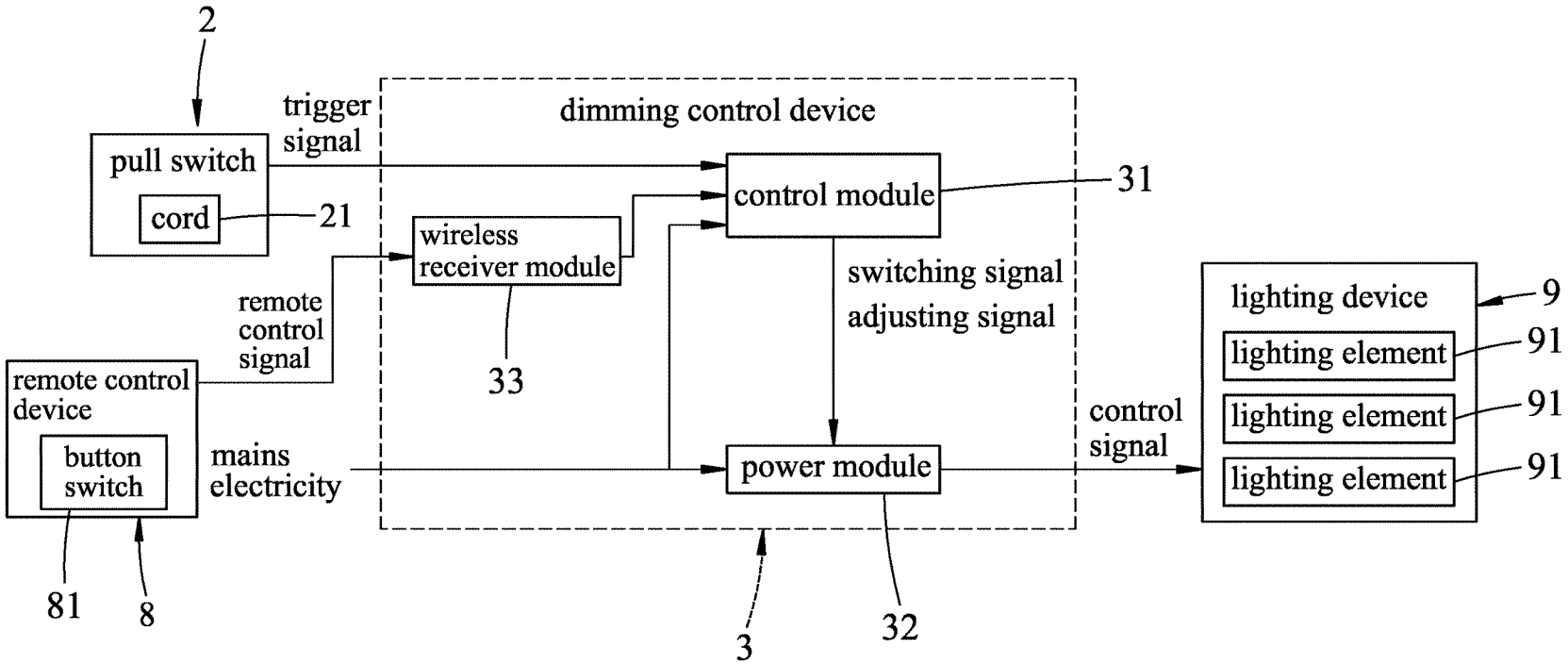
FIG. 3 is a block diagram of a third embodiment of a dimming control system according to this disclosure.

Referring to FIG. 3, the third embodiment of a dimming control system according to this disclosure is shown to be similar to the first embodiment. In the third embodiment, the dimming control system further includes a remote control device 8 that includes a button switch 81 and is operable to emit a remote control signal. The remote control signal is indicative of a pressed duration for which the button switch 81 is pressed and held in a pressed state. The dimming control device 3 further includes a wireless receiver module 33 that is electrically connected to the control module 31, and is configured to wirelessly receive the remote control signal from the remote control device 8 and to transfer the remote control signal to the control module 31. The operation of the control module 31 according to the remote control signal is similar to that according to the trigger signal. Namely, the control module 31 is operable to output the switching signal when the pressed duration indicated by the remote control signal is shorter than the first predetermined duration, and to output the adjusting signal when the pressed duration is not shorter than the first predetermined duration. In the third embodiment, the user can operate the dimming control device 3 to adjust the lighting device 9 by operating the pull switch 2 or the remote control device 8.

In sum, some advantages of the dimming control system according to this disclosure are as described below.

First, by virtue of the dimming control device 3, the dimming control system according to this disclosure allows the user to steplessly adjust the brightness of light by pulling and holding the cord 21, and to choose a desired one of the preset levels of the brightness of light in discrete steps by rapidly pulling and releasing the cord 21 a corresponding number of times. While the conventional ceiling lamp brightness control device can only adjust the brightness in a limited number of discrete steps, the dimming control system according to this disclosure can not only switch among the first to fourth modes to adjust a number of active one(s) of the lighting elements 91 for providing the preset levels of the brightness, but can also provide stepless adjustment in the brightness. Since the power module 32 can steplessly adjust the brightness of light emitted from the active one (s) of the lighting elements 91 in a substantially synchronous manner, light emitted from the lighting device 9 can be tuned to be relatively soft, uniform and comfortable to the user's eyes.

Second, the first predetermined duration and the second predetermined duration can be adjusted according to the user's demands so as to alleviate the error rate on outputting the switching signal and the adjusting signal. For example, when the user is an elder, it may take more time for the user to pull and release the cord 21 to switch the power module 32 among the first to fourth modes. In this case, the first predetermined duration and the second predetermined duration can be adjusted to be relatively longer (such as three and four seconds, respectively) to prevent the control module 31 from incorrectly adjusting the brightness of light when the user actually wants to switch among the different modes of the lighting device 9.

Further, the dimming control device 3 according to this disclosure can be sold independently. Consumers can only purchase the dimming control device 3 and/or the pull switch 2 suitable for the dimming control device 3, and install the dimming control device 3 and/or the pull switch 2 with an existing lighting device, for example, a ceiling lamp or a ceiling fan with a lamp. Therefore, the dimming control device 3 is relatively convenient, and may have a great market potential.

Finally, by determining whether the electricity has been processed by the dimmer 4, the dimming control device 3 and the dimmer 4 can be prevented from interfering with each other.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A dimming control device configured to be electrically connected to a pull switch for controlling a lighting device, the pull switch including a cord and being configured to output a trigger signal indicative of a pulled duration for which the cord is pulled and held in a pulled state, the lighting device including a plurality of lighting elements, said dimming control device comprising:

a control module configured to receive electricity and to be electrically connected to the pull switch for receiving the trigger signal; and a power module electrically connected to said control module, and configured to receive the electricity and to be electrically connected to the lighting device, said power module to be controlled by said control module according to the trigger signal to operate the lighting device by one of turning on at least a part of the lighting elements, turning off all the lighting elements, and steplessly adjusting brightness of light emitted from active one(s) of the lighting elements that is(are) turned on.

2. The dimming control device of claim 1, wherein said control module is configured to output to said power module one of a switching signal and an adjusting signal according to the trigger signal and a first predetermined duration, and wherein said power module is configured to operate the lighting device according to one of the switching signal and the adjusting signal that is received.

3. The dimming control device of claim 2, wherein said power module is configured to:

adjust a number of the active one(s) of the lighting elements by one of turning on at least a part of the lighting elements and turning off all the lighting elements upon receiving the switching signal; and when receiving the adjusting signal, steplessly adjust the brightness of light emitted from the active one(s) of the lighting elements until the adjusting signal ends, and maintain the brightness of light after the adjusting signal ends.

4. The dimming control device of claim 3, wherein said control module is configured to output the switching signal when the pulled duration indicated by the trigger signal is shorter than the first predetermined duration, and to output the adjusting signal when the pulled duration is not shorter than the first predetermined duration.

5. The dimming control device of claim 3, wherein said control module is configured to output the switching signal when the pulled duration indicated by the trigger signal is shorter than the first predetermined duration, and to output the adjusting signal when the pulled duration is longer than a second predetermined duration that is longer than the first predetermine duration.

6. The dimming control device of claim 3, wherein said control module and said power module are further configured to be electrically connected to a dimmer, wherein said control module is further configured to determine whether the electricity received thereby has been processed by the dimmer by detecting a zero-crossing point of the electricity, and to control said power module to directly provide the electricity to the lighting device without further processing the electricity when it is determined that the electricity has been processed by the dimmer.

7. The dimming control device of claim 1, wherein when two or more of the lighting elements is active, said power module is configured to steplessly adjust the brightness of light emitted from the active ones of the lighting elements in such a manner that brightness is uniform among the individual active ones of the lighting elements.

8. The dimming control device of claim 1, wherein said power module is configured to turn on at least a part of the lighting elements by providing the electricity thereto, to adjust the brightness of light emitted from the active one (s) of the lighting elements by adjusting electric power of the electricity provided thereto, and to turn off all the lighting elements by ceasing to provide the electricity to the lighting elements.

9. The dimming control device of claim 1, further comprising a wireless receiver module that is electrically connected to said control module, and that is configured to receive a remote control signal from a remote control device and to transfer the remote control signal to said control module, the remote control signal being indicative of a pressed duration for which a button switch of the remote control device is pressed and held in a pressed state, wherein said control module is operable further according to the remote control signal to control said power module to operate the lighting device.

10. A dimming control system for controlling a lighting device including a plurality of lighting elements, the dimming control system comprising:

a pull switch including a cord and being configured to output a trigger signal indicative of a pulled duration for which the cord is pulled and held in a pulled state; and a dimming control device configured to be electrically connected to said pull switch, including:

a control module configured to receive electricity and to be electrically connected to said pull switch for receiving the trigger signal; and a power module electrically connected to said control module, and configured to receive the electricity and to be electrically connected to the lighting device, said power module to be controlled by said control module according to the trigger signal to operate the lighting device by one of turning on at least a part of the lighting elements, turning off all the lighting elements, and steplessly adjusting brightness of light emitted from active one(s) of the lighting elements that is(are) turned on.

11. The dimming control system of claim 10, wherein said control module is configured to output, to said power module, one of a switching signal and an adjusting signal according to the trigger signal and a first predetermined duration, and wherein said power module is configured to:

adjust a number of the active one(s) of the lighting elements by one of turning on at least a part of the lighting elements and turning off all the lighting elements upon receiving the switching signal; and adjust the brightness of light emitted from the active one(s) of the lighting elements until the adjusting signal ends, and maintain the brightness of light after the adjusting signal ends.

12. The dimming control system of claim 10, wherein said control module is configured to output the switching signal when the pulled duration indicated by the trigger signal is shorter than the first predetermined duration, and to output the adjusting signal when the pulled duration is not shorter than the first predetermined duration.

13. The dimming control system of claim 10, wherein said control module is configured to output the switching signal when the pulled duration indicated by the trigger signal is shorter than the first predetermined duration, and to output the adjusting signal when the pulled duration is longer than the second predetermined duration that is longer than the first predetermine duration.

14. The dimming control system of claim 10, wherein said control module and said power module are further configured to be electrically connected to a dimmer, wherein said control module is further configured to determine whether the electricity has been processed by the dimmer by detecting a zero-crossing point of the electricity, and to control said power module to directly provide the electricity to the lighting device without further processing the electricity when it is determined that the electricity has been processed by the dimmer.

15. The dimming control system of claim 10, further comprising a remote control device that includes a button switch, and that is operable to emit a remote control signal indicative of a pressed duration for which said button switch of said remote control device is pressed and held in a pressed state, wherein said dimming control device further includes a wireless receiver module that is electrically connected to said control module, and that is configured to receive the remote control signal from said remote control device and to transfer the remote control signal to said control module, wherein said control module is operable further according to the remote control signal to control said power module to operate the lighting device.

* * * * *